US008104446B2

(12) United States Patent
Shimazaki et al.

(10) Patent No.: US 8,104,446 B2
(45) Date of Patent: Jan. 31, 2012

(54) ENGINE WITH CARBURETOR MOUNTED ON AN INSULATOR

(75) Inventors: Takayoshi Shimazaki, Kawagoe (JP); Syouta Takeshima, Kawagoe (JP)

(73) Assignee: Husqvarna Zenoah Co., Ltd., Kawagoe-Shi (JP)

( * ) Notice: Subject to any disclaimer, the term of this patent is extended or adjusted under 35 U.S.C. 154(b) by 552 days.

(21) Appl. No.: 12/303,549

(22) PCT Filed: Jun. 4, 2007

(86) PCT No.: PCT/JP2007/061275

§ 371 (c)(1),
(2), (4) Date: Dec. 4, 2008

(87) PCT Pub. No.: WO2007/142180

PCT Pub. Date: Dec. 13, 2007

(65) Prior Publication Data

US 2009/0224532 A1 Sep. 10, 2009

(30) Foreign Application Priority Data

Jun. 6, 2006 (JP) ..... 2006-157772

(51) Int. Cl.
*F02M 35/10* (2006.01)

(52) U.S. Cl. ..... 123/184.23; 285/47

(58) Field of Classification Search ..... 123/65 R, 123/184.21, 184.23, 184.46; 285/47
See application file for complete search history.

(56) References Cited

FOREIGN PATENT DOCUMENTS

| | | | |
|---|---|---|---|
| JP | 63-166654 | A | 10/1988 |
| JP | 5-19545 | A | 3/1993 |
| JP | 2004-360656 | A | 12/2004 |

OTHER PUBLICATIONS

International Preliminary Report on Patentability and Written Opinion dated Jan. 13, 2009, issued in connection with International Application Serial No. PCT/JP2007/061275.

English Language International Search Report dated Aug. 14, 2007 issued in parent Appln. No. PCT/JP2007/061275.

*Primary Examiner* — Noah Kamen
(74) *Attorney, Agent, or Firm* — Holtz, Holtz, Goodman & Chick, PC

(57) ABSTRACT

Screw holes are provided on a contacting surface of an insulator so as to enable a carburetor to be mounted on the insulator at a plurality of positions rotated about an axial center of an intake hole. The insulator is mounted on a cylinder at a predetermined position while the carburetor is mounted on the insulator by inserting bolts for mounting the carburetor into the screw holes through through holes of the carburetor. Accordingly, the carburetor can be mounted at a plurality of positions rotated about the axial center of intake holes relative to an engine body. Thus, a protruding direction of a throttle lever from the carburetor, i.e., an operating direction of the throttle lever, can be changed.

3 Claims, 9 Drawing Sheets

ENGINE WITH CARBURETOR MOUNTED ON AN INSULATOR

TECHNICAL FIELD

The present invention relates to an engine, and more particularly to improvements in a carburetor mounting structure on an engine body.

BACKGROUND ART

A conventional engine includes a carburetor mounted on an engine body through an insulator. The engine body, the insulator, and the carburetor of the conventional engine respectively have an intake hole. The carburetor is mounted on the engine body such that all the intake holes communicate with each other to provide a passage for delivering an air-fuel mixture generated by the carburetor to the engine.

In the carburetor, an opening degree of a throttle valve is changed by operating a throttle lever in order to adjust an amount of air sucked by the carburetor. Accordingly, air and fuel can be mixed at an appropriate ratio for sufficient combustion in the engine.

Therefore, it is necessary that an operating mechanism such as a wire or a link is provided for operating the throttle lever.

In such an engine, a positional relationship between the engine body and the carburetor is fixed (for example, see Patent Document 1) and therefore a position of the throttle lever is fixed relative to the engine body.

Patent Document 1: JP-A-2004-360656

DISCLOSURE OF THE INVENTION

Problems to be Solved by the Invention

However, when an engine, in which a position of a throttle lever is fixed relative to an engine body as described above, is mounted on a radio-controlled model airplane, for instance, some parts of the airplane may cause interference with an operating mechanism for operating a throttle lever depending on a design of the airplane. Thus, there has been a need for a throttle lever of which an operation direction can be changed. In other words, the engine on which a carburetor is fixedly mounted sometimes does not work appropriately in the airplane having various designs as an equipment in which the engine is installed. Consequently, a design freedom of the airplane has been limited.

An object of the invention is to provide an engine in which a position of a throttle lever of a carburetor can be changed, the engine being capable of increasing a design freedom of an equipment in which the engine is installed.

Means for Solving the Problems

An engine according to an aspect of the invention including an engine body, an insulator, and a carburetor each having an intake hole, the carburetor mounted on the engine body via the insulator such that all the intake holes communicate with each other, the engine includes a mounting unit capable of mounting the carburetor on the engine body at any of a plurality of positions by being rotated about an axial center of the intake holes, in which the carburetor is mounted on the engine body at one of the plurality of mounting positions.

According to the aspect of the invention, the carburetor is mountable on the engine body at any of the plurality of positions by being rotated. Thus, a protruding direction of a throttle lever from the carburetor, i.e., an operating direction of the throttle lever, can be changed.

Also, since the carburetor is mounted on the engine body by being rotated about the axial center of the intake hole, the intake holes can always communicate with each other irrespective of a rotation of the carburetor.

It is preferable that the mounting unit mounts the insulator on the engine body at a predetermined position while the mounting unit is capable of mounting the carburetor on the insulator at any of a plurality of positions by being rotated about the axial center of the intake holes, and the insulator is provided with a communicating hole independently from the intake hole, the communicating hole intercommunicating between a communicating hole provided on the carburetor and a communicating hole provided on the engine body while a circular communicating groove that intercommunicates between the communicating hole provided on the carburetor and a communicating hole provided on the insulator is provided on a contacting surface at which the insulator and the carburetor contact each other.

According to such an arrangement, the carburetor is mountable on the insulator at any of the plurality of positions by being rotated. Consequently, the carburetor is mountable on the engine body at any of the plurality of positions. Also, since the circular communicating groove is provided to intercommunicate between the communicating hole of the insulator and the communicating hole of the carburetor on the contacting surface at which the insulator and the carburetor contact each other when the carburetor is mounted on the insulator, the communicating holes can always communicate with each other irrespective of a mounting position.

Further, only the insulator needs to be processed such that the carburetor is mountable on the insulator at any of the plurality of positions by being rotated about the axial center of the intake holes. The processing of the insulator, which is smaller than the engine body, is easier than processing of the engine body.

In the two-stroke engine, for instance, a pulse hole works as the communicating hole, the pulse hole being a passage provided for transferring a negative pressure of the engine in order to operate a pump that sends fuel to the carburetor. Also, in a stratified scavenging two-stroke engine, a leading air passage may work as the communicating hole, the leading air passage being a passage provided for sucking leading air into the engine for scavenging an air-fuel mixture.

It is preferable that the mounting unit mounts the carburetor on the insulator at a predetermined position while the mounting unit is capable of mounting the insulator on the engine body at any of a plurality of positions by being rotated about the axial center of the intake holes, and the insulator is provided with a communicating hole independently from the intake hole, the communicating hole intercommunicating between a communicating hole provided on the carburetor and a communicating hole provided on the engine body while a circular communicating groove that intercommunicates between the communicating hole provided on the engine body and a communicating hole provided on the insulator is provided on a contacting surface at which the engine body and the insulator contact each other.

According to such an arrangement, the insulator is mountable on the engine body at any of the plurality of positions by being rotated. Consequently, the carburetor is mountable on the engine body at any of the plurality of positions. Also, since the circular communicating groove that intercommunicates between the communicating hole of the insulator and the communicating hole of the engine body is provided on the contacting surface at which the insulator and the engine body contact each other when the insulator is mounted on the engine body, the communicating holes can always communicate with each other irrespective of a mounting position.

It is preferable that the mounting unit is capable of mounting the carburetor on the insulator at any of a plurality of positions by being rotated about the axial center of the intake holes and mounting the insulator on the engine body at any of a plurality of positions by being rotated about the axial center of the intake holes, and the insulator is provided with a communicating hole independently from the intake hole, the communicating hole intercommunicating between a communicating hole provided on the carburetor and a communicating hole provided on the engine body while a circular communicating groove that intercommunicates between the communicating hole provided the carburetor and a communicating hole provided on the insulator is provided on a contacting surface at which the carburetor and the insulator contact each other and another circular communicating groove that intercommunicates between the communicating hole provided on the engine body and the communicating hole provided on the insulator is provided on a contacting surface at which the engine body and the insulator contact each other.

According to such an arrangement, the carburetor is mountable on the insulator at any of the plurality of positions by being rotated and the insulator is mountable on the engine body at any of the plurality of positions by being rotated. Consequently, the carburetor is mountable on the engine body at any of the plurality of positions.

For example, the mounting unit is capable of mounting the carburetor on the insulator at four positions spaced 90 degrees by being rotated, and mounting the insulator on the engine body at a predetermined position and a position spaced 45 degrees from the predetermined position in a direction that the carburetor rotates. Thus, the carburetor is mountable on the engine body at eight positions spaced 45 degrees from each other. Consequently, a number of possible mounting positions of the carburetor relative to the engine body can be increased as compared with a case where the mounting unit is provided on only one contacting surface.

Also, the circular communicating grooves are provided on the contacting surface at which the insulator and the carburetor contact each other and on the contacting surface at which the engine body and the insulator contact each other so as to intercommunicate the communicating holes. Thus, the communicating holes can always communicate with each other irrespective of a rotation of the carburetor to be mounted on the insulator, or the insulator to be mounted on the engine body.

EXPLANATION OF CODES

1: two-stroke engine, 2: engine body, 3: cylinder, 7: insulator, 8: carburetor, 11: bolt, 32: intake hole, 33: pulse hole (communicating hole), 74: intake hole, 75: pulse hole (communicating hole), 77: communicating groove, 79: screw hole, 81: intake hole, 82: pulse hole (communicating hole), 84: throttle lever, 85: through hole

BEST MODE FOR CARRYING OUT THE INVENTION

Exemplary embodiments of the invention will be described below with reference to the drawings.

First Exemplary Embodiment

Figure 1:
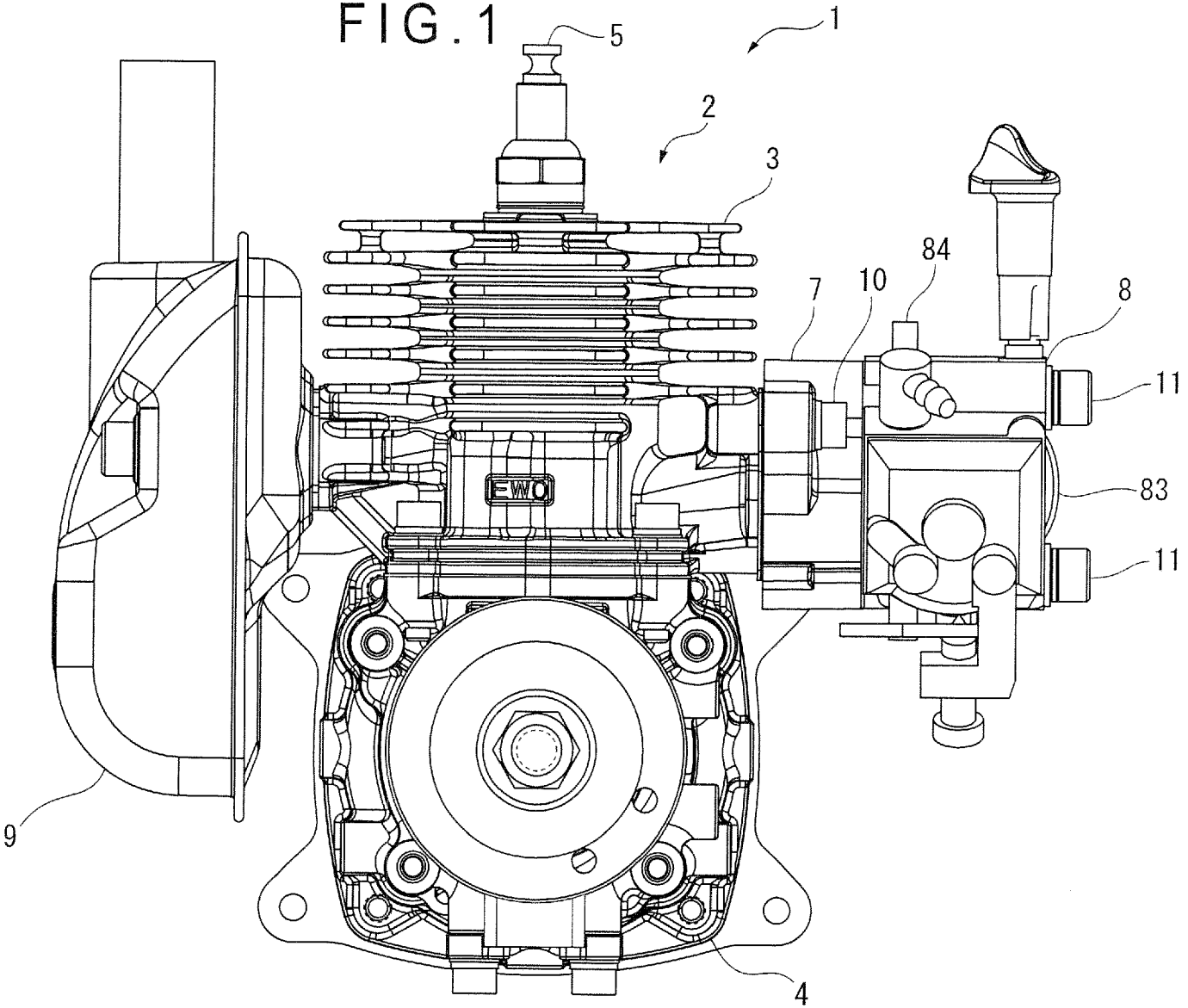
FIG. 1 is a front view illustrating a two-stroke engine according to a first exemplary embodiment of the invention.
Figure 2:
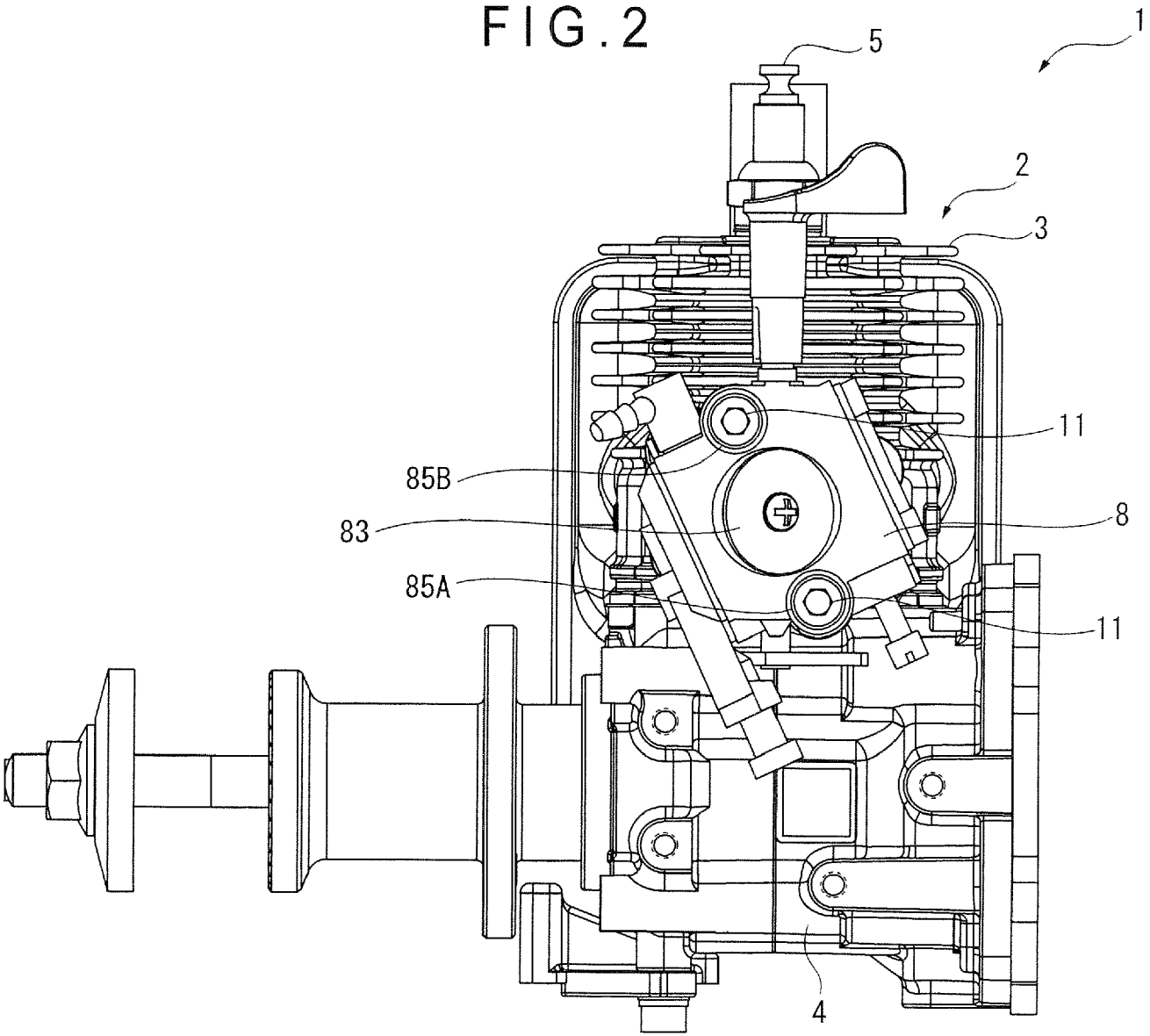
FIG. 2 is a side view of the engine.
Figure 3:
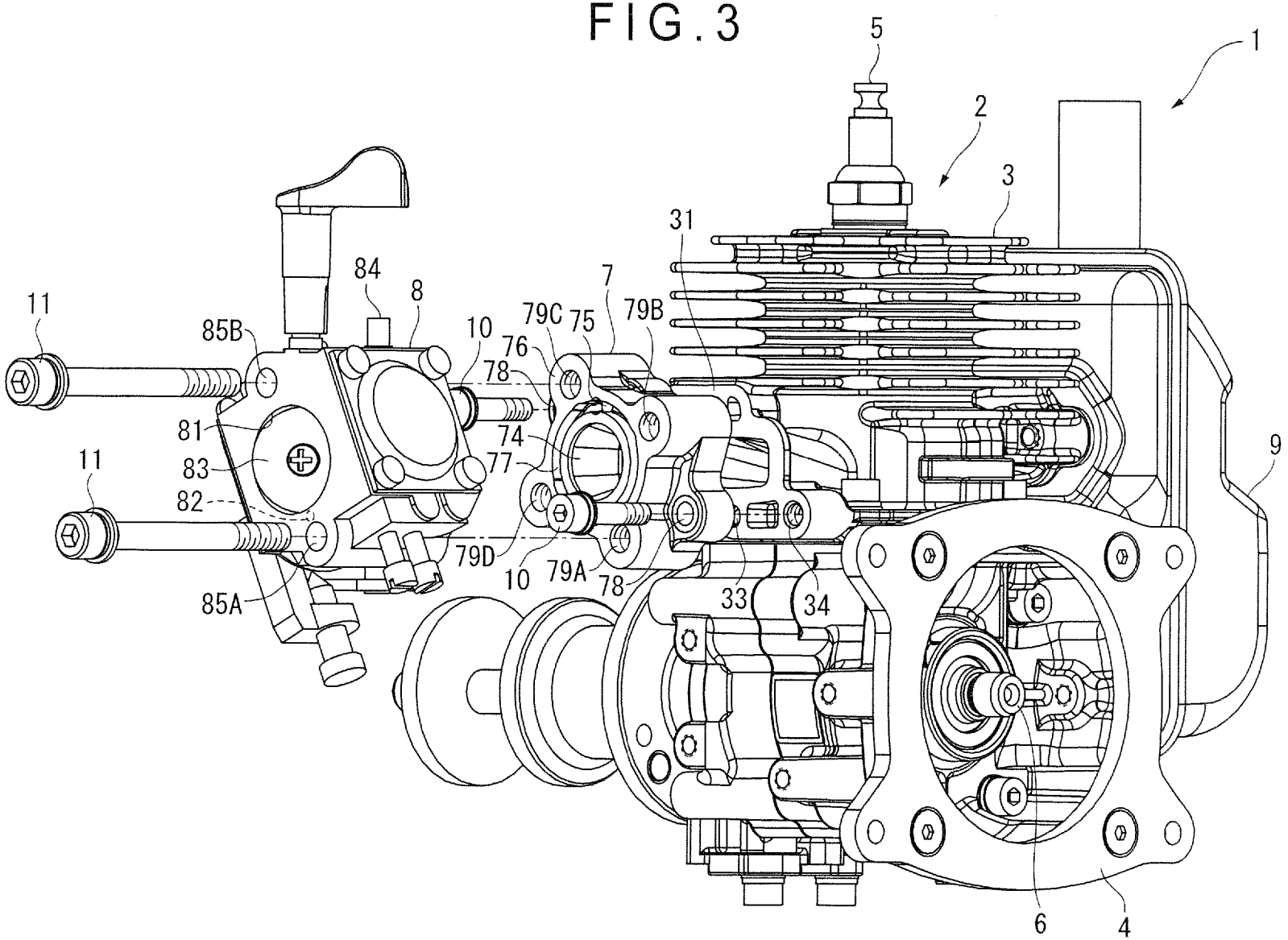
FIG. 3 is an exploded perspective view of a primary portion of the engine.
Figure 4:
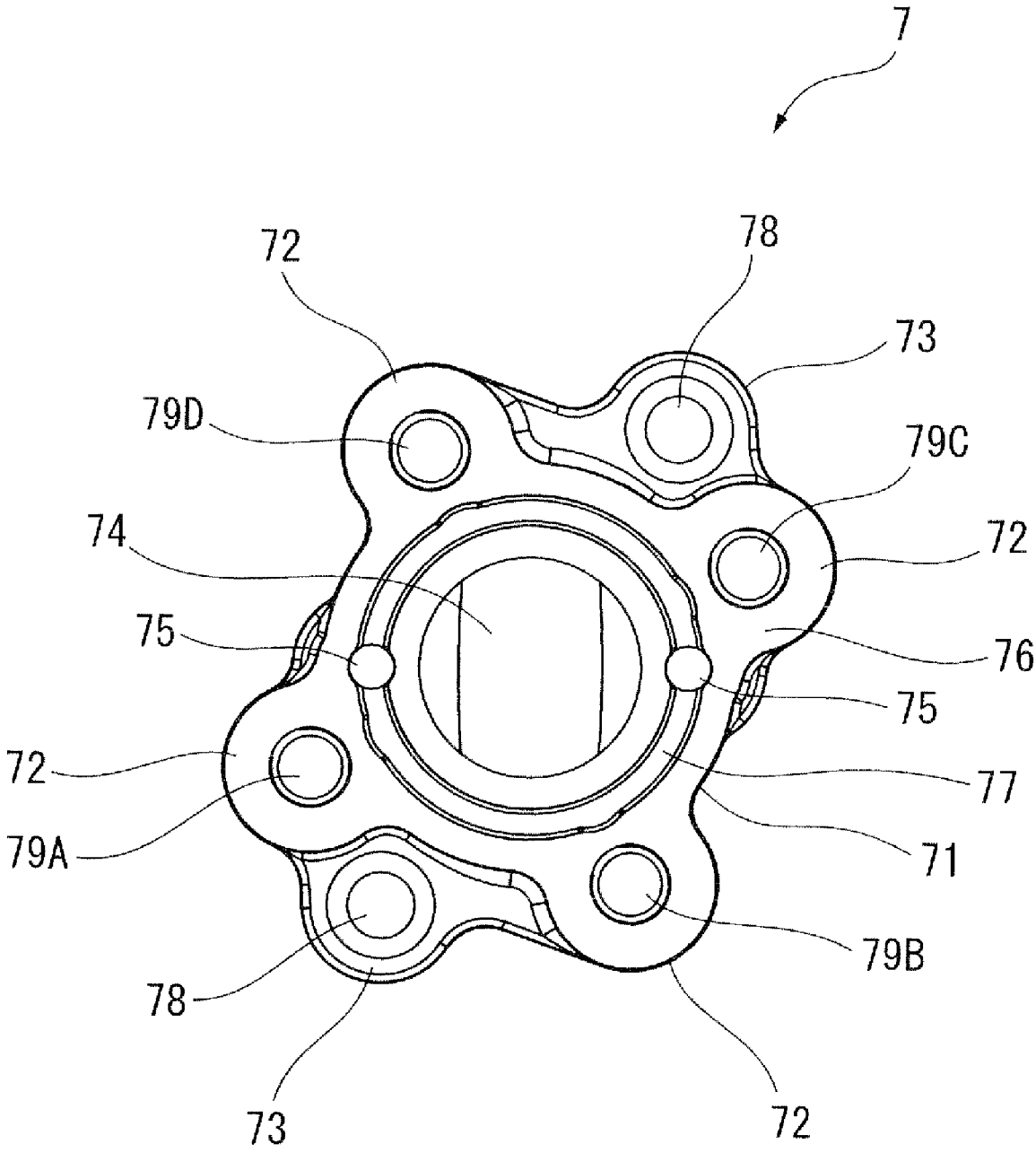
FIG. 4 illustrates parts of an insulator according to the first exemplary embodiment.

FIGS. 1 through 4 illustrate a first exemplary embodiment of the invention. FIG. 1 is a front view of a two-stroke engine, FIG. 2 is a side view of the engine, FIG. 3 is an exploded perspective view of a primary portion of the engine, and FIG. 4 illustrates parts of an insulator.

A two-stroke engine 1 shown in FIGS. 1 to 3 includes an engine body 2, an ignition plug 5 provided on one side of the engine body 2 as shown in an upper side in FIG. 1, a crankshaft 6 (FIG. 3) rotatably supported by the engine body 2, a carburetor 8 mounted on a lateral side of the engine body 2 through an insulator 7 as shown in a right side in FIG. 1, and a muffler 9 mounted on the other lateral side of the engine body 2 as shown in a left side in FIG. 1.

The engine body 2 includes a cylinder 3 having a plurality of fins and a crankcase 4 provided on the cylinder 3 as shown in a lower side in FIG. 1.

An intake hole 32 and a pulse hole 33 (a communicating hole) are opened on a contacting surface 31 of the cylinder 3, the contacting surface 31 contacting the insulator 7. Screw holes 34 for mounting the insulator 7 are provided at two positions equally spaced 180 degrees from each other on a virtual circle concentric with the intake hole 32 (only one of the two positions is shown in FIG. 3).

Next, the insulator 7 will be described with reference to FIG. 4.

The insulator 7, which is formed of a heat-resistant plastic member or the like, prevents engine heat from being transferred to the carburetor 8. Four protrusions 72 are equally spaced 90 degrees from each other on a circumferential surface of a flat cylindrical body 71 and two flanges 73 are equally spaced 180 degrees from each other on the circumferential surface of the flat cylindrical body 71. Accordingly, an entire structure of the insulator 7 is symmetrical with respect to a point.

The insulator 7 includes an intake hole 74 at a central portion thereof. Two pulse holes 75 are provided as communicating holes for communicating with the pulse hole 33 of the cylinder 3 on an outer circumference of the intake hole 74 of the insulator 7.

Therefore, even when the insulator 7 is rotated by 180 degrees around an axial center of the intake hole 74 to be mounted on the cylinder 3, the pulse hole 33 of the cylinder 3 can communicate with one of the pulse holes 75 of the insulator 7, which improves the mounting property of the insulator 7.

A communicating groove 77 in the form of a circular groove (which has a ring-shape according to the first exemplary embodiment) including the two pulse holes 75 is provided to be concentric with the intake hole 74 on a circumference of the intake hole 74 of a contacting surface 76, i.e., one surface of the insulator 7, that contacts the carburetor 8.

Two through holes 78 are respectively provided on the flanges 73 of the insulator 7. Bolts 10 respectively penetrate the through holes 78 to be screwed with the screw holes 34 formed on the cylinder 3 to fix the insulator 7 to the cylinder 3.

Screw holes 79 for mounting the carburetor 8 are respectively provided on the four protrusions 72 of the insulator 7. Central positions of the screw holes 79 are equally spaced 90 degrees from each other on the virtual circle concentric with the intake hole 74.

The screw holes 79 are counterclockwise denoted as 79A through 79D for distinguishing therebetween as shown in FIG. 4.

The carburetor 8 has a typical structure. The carburetor 8 has a substantially block shape and includes an intake hole 81 penetrating a center portion of the carburetor 8 A pulse hole 82 communicating with one of the pulse holes 75 of the insulator 7 penetrates the carburetor 8. In the intake hole 81 of the carburetor 8, a throttle valve 83 in the form of a butterfly valve is provided at a position opposite to a contacting surface (not shown) thereof that contacts the insulator 7 and is rotatable via a valve shaft (not shown). A throttle lever 84 projects from the valve axis of the carburetor 8 on an upper side as shown in FIG. 1.

Therefore, an opening degree of the throttle valve 83 is changed by operating the throttle lever 84 so that an amount of air sucked by the carburetor 8 can be adjusted. The throttle lever 84 is connected to an equipment on which an engine is mounted, for instance, a driving unit in a radio-controlled model airplane, through an operating mechanism such as a wire or a link (not shown).

Two through holes 85 interposing the intake hole 81 therebetween are provided on the carburetor 8 to be spaced 180 degrees from each other. In other words, the two through holes 85 face the two holes (79A and 79C in FIG. 3) on a diagonal line of the screw holes 79 of the insulator 7. Bolts 11 respectively penetrate the through holes 85 to be screwed with the screw holes 79, so that the carburetor 8 is fixed to the insulator 7.

The two through holes 85 are denoted as 85A and 85B for distinguishing therebetween as shown in the figures.

The contacting surface of the carburetor 8, which contacts the insulator 7, has a planar shape.

The carburetor 8 as shown in FIGS. 1 and 2 is mounted on the insulator 7 such that the through holes 85A and 85B correspond to the screw holes 79A and 79C, respectively. Accordingly, though not illustrated, the throttle lever 84 protrudes from the carburetor 8 on an upper side in FIG. 2.

In this exemplary embodiment, a mounting unit is provided by the through holes 78 of the insulator 7 for mounting the insulator 7 on the cylinder 3, the screw holes 34 of the cylinder 3, and the bolts 10 for mounting the insulator 7. Another mounting unit is provided by the through holes 85 of the carburetor 8 for mounting the carburetor 8 to the insulator 7, the screw holes 79 of the insulator 7, and the bolts 11 for mounting the carburetor 8.

Next, a mounting method according to the first exemplary embodiment will be described with reference to FIGS. 5 through 7.

Figure 5:
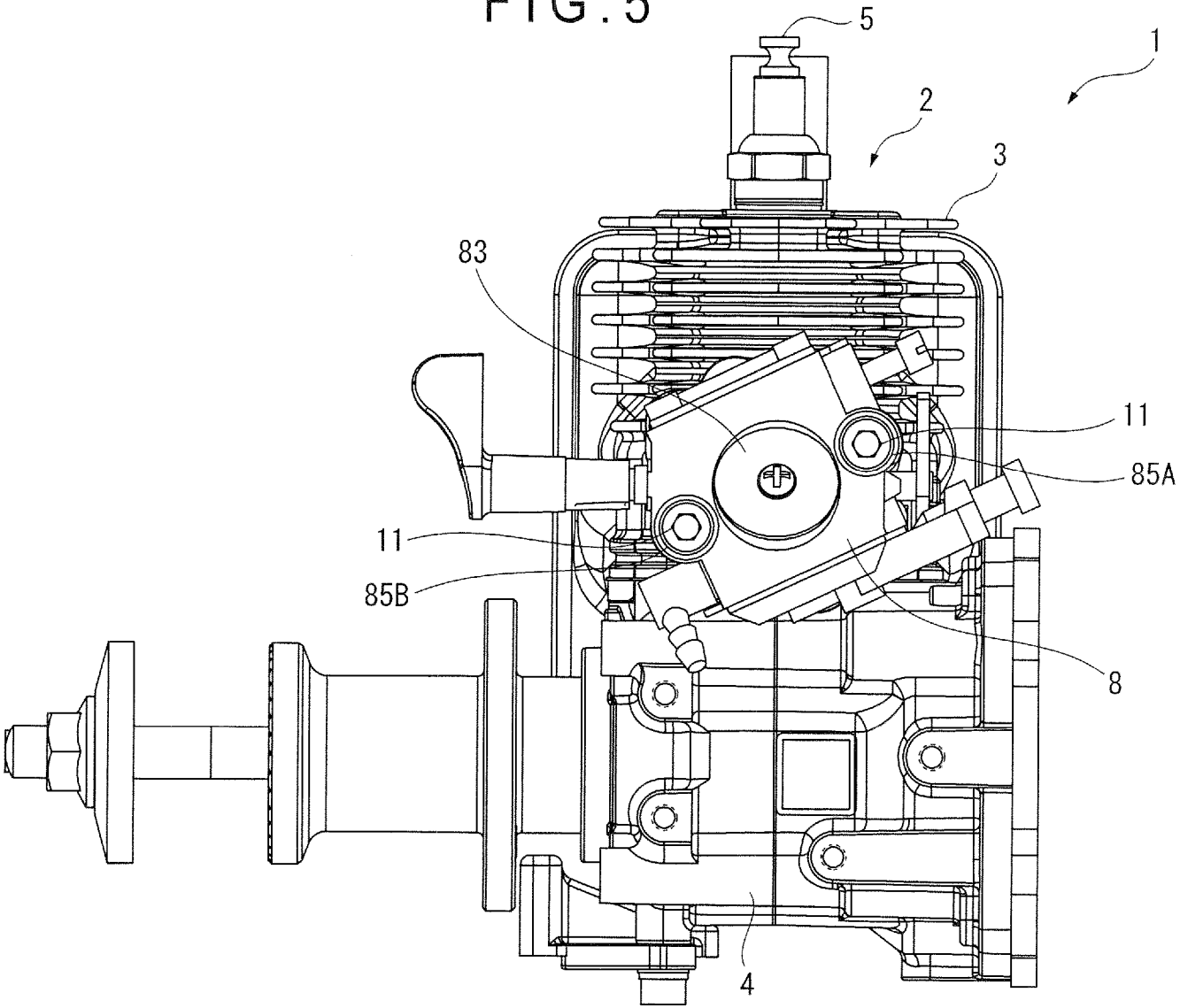
FIG. 5 is a side view of the engine on which a carburetor is mounted by being rotated by 90 degrees according to the first exemplary embodiment.

FIG. 5 is a side view of the two-stroke engine 1 on which the carburetor 8 is mounted by being counterclockwise rotated by 90 degrees from a position of the carburetor 8 as shown in FIG. 2. FIG. 6 is a side view of the engine 1 on which the carburetor 8 is mounted by being counterclockwise rotated by 180 degrees from the position as described above. FIG. 7 is a side view of the engine 1 on which the carburetor 8 is mounted by being counterclockwise rotated by 270 degrees from the position as described above.

The mounting method for changing a mounting position of the carburetor 8 relative to the engine body 2 will be described below because it is important for the invention that the mounting position of the carburetor 8 relative to the engine body 2 can be changed when the carburetor 8 is mounted on the engine 1 so as to prevent interference between the operating mechanism of the throttle lever 84 and the equipment on which the engine 1 is mounted.

The insulator 7 is mounted on the cylinder 3 of the engine body 2 at a predetermined position. When the carburetor 8 is mounted on the insulator 7 in a rotated matter, any two holes on a diagonal line are selected from the screw holes 79 on the insulator 7. Consequently, the carburetor 8 can be mounted on the insulator 7 at any of the four positions equally spaced 90 degrees from each other. For example, as shown in FIG. 5, the carburetor 8 is counterclockwise rotated by 90 degrees from a position of the carburetor 8 as shown in FIG. 3. At this time, the carburetor 8 is mounted on the insulator 7 such that the through holes 85A and 85B of the carburetor 8 correspond to the screw holes 79B and 79D of the insulator 7, respectively. Accordingly, the carburetor 8 is mounted at a position as shown in FIG. 5 and the throttle lever 84 (not shown) protrudes from the carburetor 8 on a left side in FIG. 5.

Figure 6:
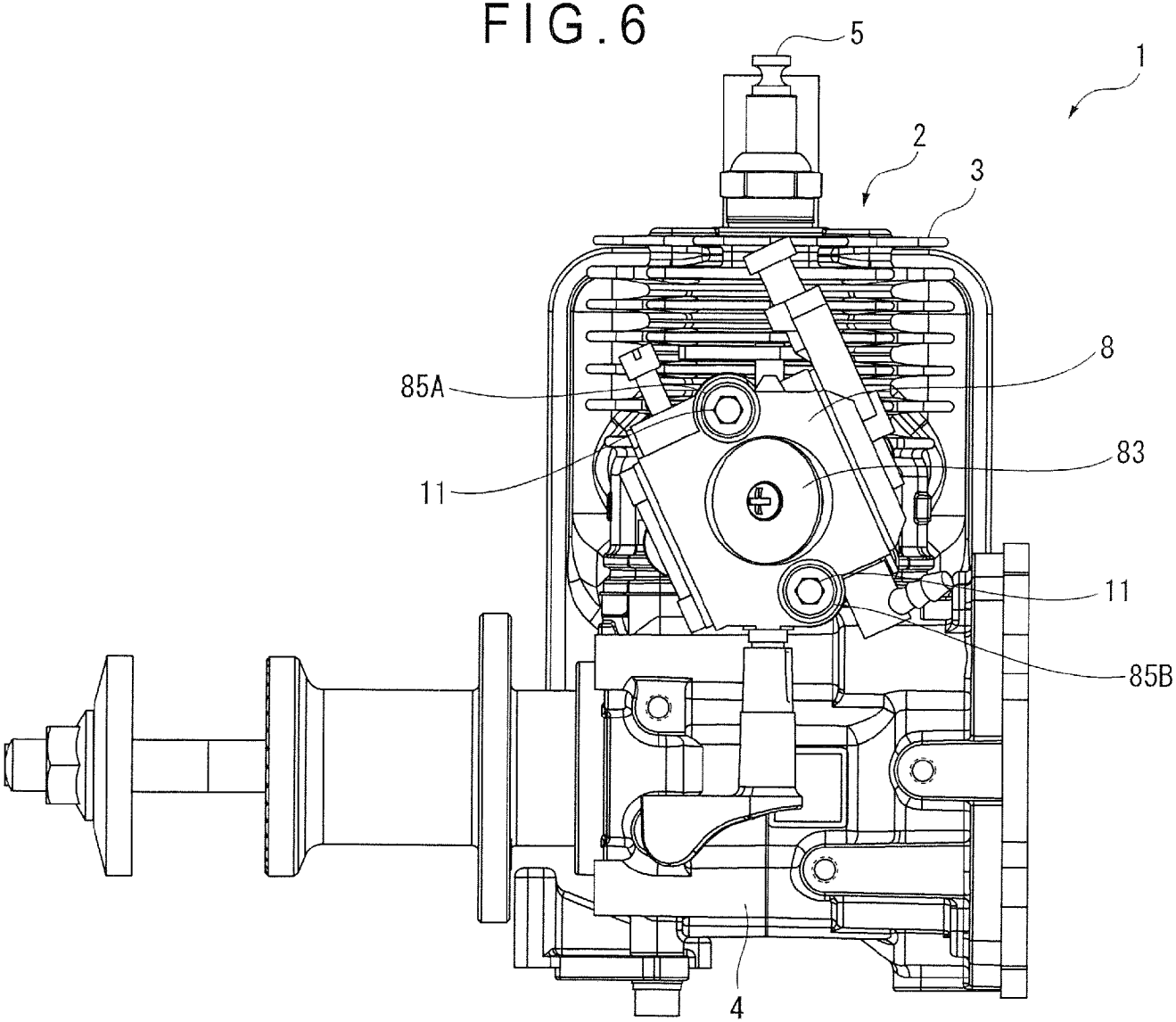
FIG. 6 is a side view of the engine on which the carburetor is mounted by being rotated by 180 degrees.
Figure 7:
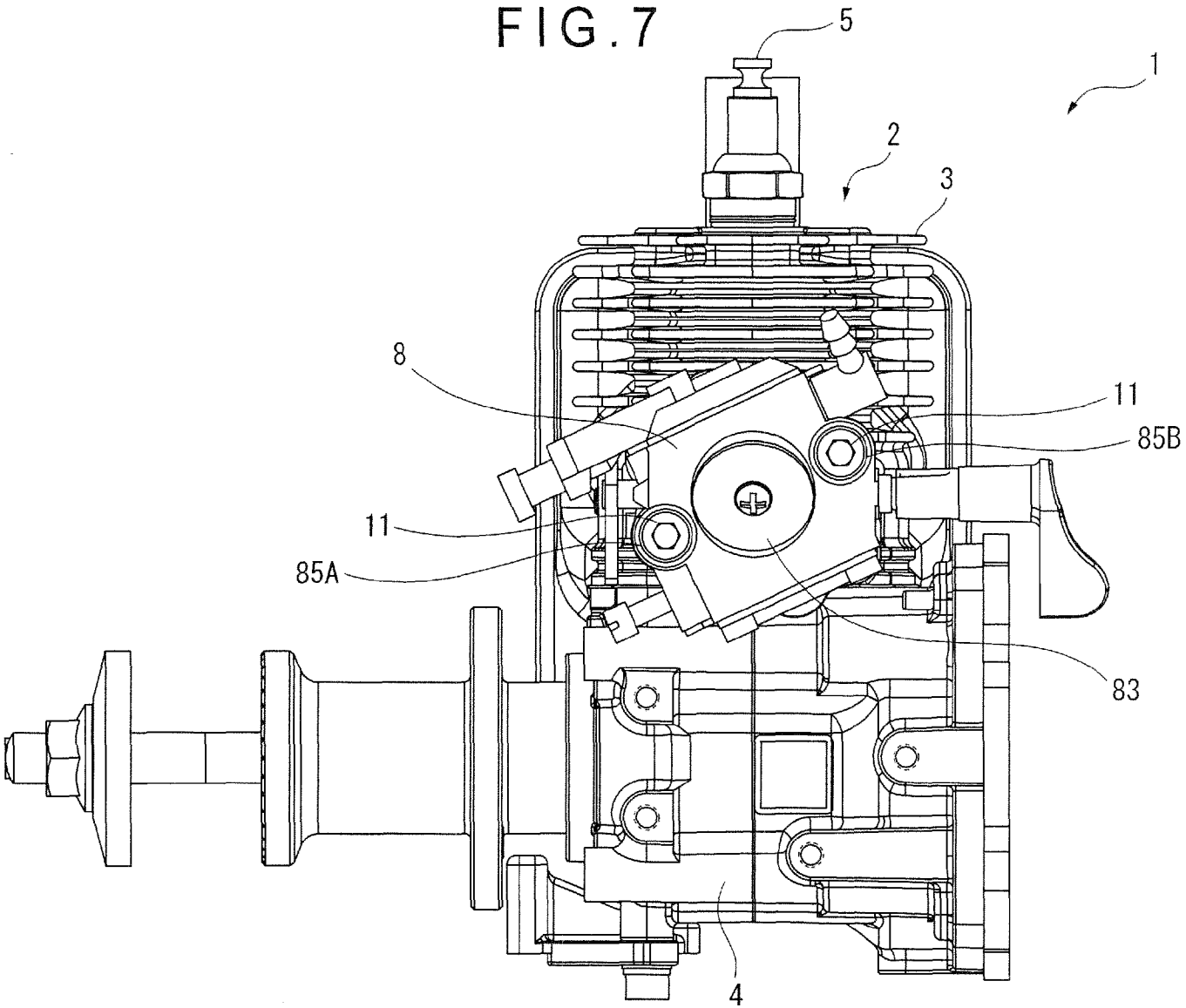
FIG. 7 is a side view of the engine on which the carburetor is mounted by being rotated by 270 degrees.

FIGS. 6 and 7 illustrate the carburetor 8 mounted on the insulator 7 by being rotated respectively by 180 degrees and by 270 degrees.

According to the arrangement as described above, the carburetor 8 can be mounted on the insulator 7 at four different positions spaced 90 degrees from each other by being rotated. Consequently, the carburetor 8 can be mounted at four different positions spaced 90 degrees from each other relative to the engine body 2. Thus, a protruding direction of the throttle lever 84 from the carburetor 8, i.e., an operating direction of the throttle lever 84, can be changed, which prevents interference between the operating mechanism of the throttle lever 84 and the equipment in which the engine 1 is installed. Also, the intake hole 74 of the insulator 7 and the intake hole 81 of the carburetor 8 can always communicate with each other irrespective of a position of the carburetor 8 because the carburetor 8 is mounted on the insulator 7 by being rotated about the axial center of the intake hole 74.

Further, the pulse hole 82 can face the communicating groove 77 even when the carburetor 8 is rotated to be mounted on the insulator 7 because the communicating groove 77 has a circular shape including the pulse holes 75 as the communicating holes to be concentric with the intake hole 74 on the contacting surface 76 of the insulator 7, the contacting surface 76 contacting the carburetor 8. In other words, one of the pulse holes 75 of the insulator 7 and the pulse hole 82 of the carburetor 8 as the communicating hole can communicate with each other through the communicating groove 77.

Furthermore, processing of the insulator 7 for providing the screw holes 79 and the communicating groove 77 thereon is easier than processing of the engine body 2 because the insulator 7 is smaller than the engine body 2.

Second Exemplary Embodiment

Figure 8:
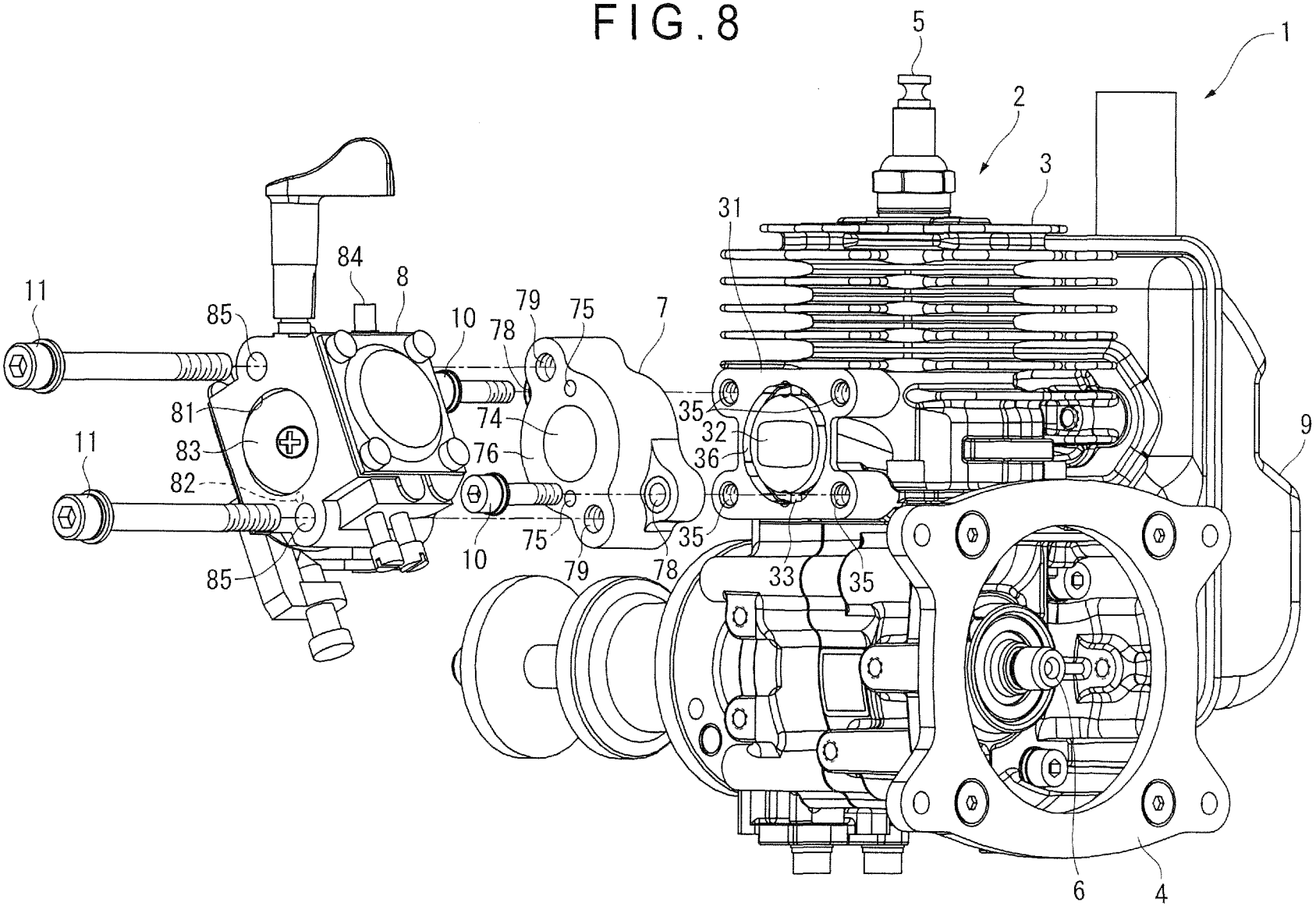
FIG. 8 is an exploded perspective view schematically illustrating a primary portion of a two-stroke engine according to a second exemplary embodiment of the invention.

FIG. 8 is an exploded perspective view of the two-stroke engine 1 according to a second exemplary embodiment of the invention. In the following description, the same members and functional portions as those of the first exemplary embodiment will be denoted by the same reference numerals, and the description thereof will be omitted or simplified.

In the second exemplary embodiment, differently from the first exemplary embodiment, the insulator 7 is mounted on the cylinder 3 at any of four positions by being rotated and the carburetor 8 is mounted on the insulator 7 at a predetermined position as shown in FIG. 8. Screw holes 35 for mounting the insulator 7 are formed on the contacting surface 31 of the cylinder 3, the contacting surface 31 contacting the insulator 7. Central positions of the screw holes 35 are equally spaced 90 degrees from each other on a virtual circle concentric with the intake hole 32. Also, the screw holes 79 of the insulator 7 are provided at two positions to face the through holes 85 of the carburetor 8.

A communicating groove 36 in the form of a circular groove (which has a ring-shape in the second exemplary embodiment) including the pulse hole 33 is provided to be concentric with the intake hole 32 on a circumference of the intake hole 32 on the contacting surface 31.

The bolts 10 for mounting the insulator 7 respectively penetrate the through holes 78 of the insulator 7 to be screwed with the screw holes 35 of the cylinder 3, and the bolts 11 for mounting the carburetor 8 respectively penetrate the through holes 85 of the carburetor 8 to be screwed with the screw holes 79 of the insulator 7.

Accordingly, the insulator 7 can be mounted on the cylinder 3 at any of four positions spaced 90 degrees from each other by being rotated. Consequently, the carburetor 8 can be mounted at any of four positions spaced 90 degrees from each other.

Further, the pulse holes 75 of the insulator 7 can face the communicating groove 36 even when the insulator 7 is rotated to be mounted on the cylinder 3 because the circular communicating groove 36 including the pulse hole 33 is provided to be concentric with the intake hole 32 on the contacting surface 31 of the cylinder 3, the contacting surface 31 contacting the insulator 7. In other words, the pulse hole 33 of the cylinder 3 and one of the pulse holes 75 of the insulator 7 can communicate with each other through the communicating groove 36.

Third Exemplary Embodiment

Figure 9:
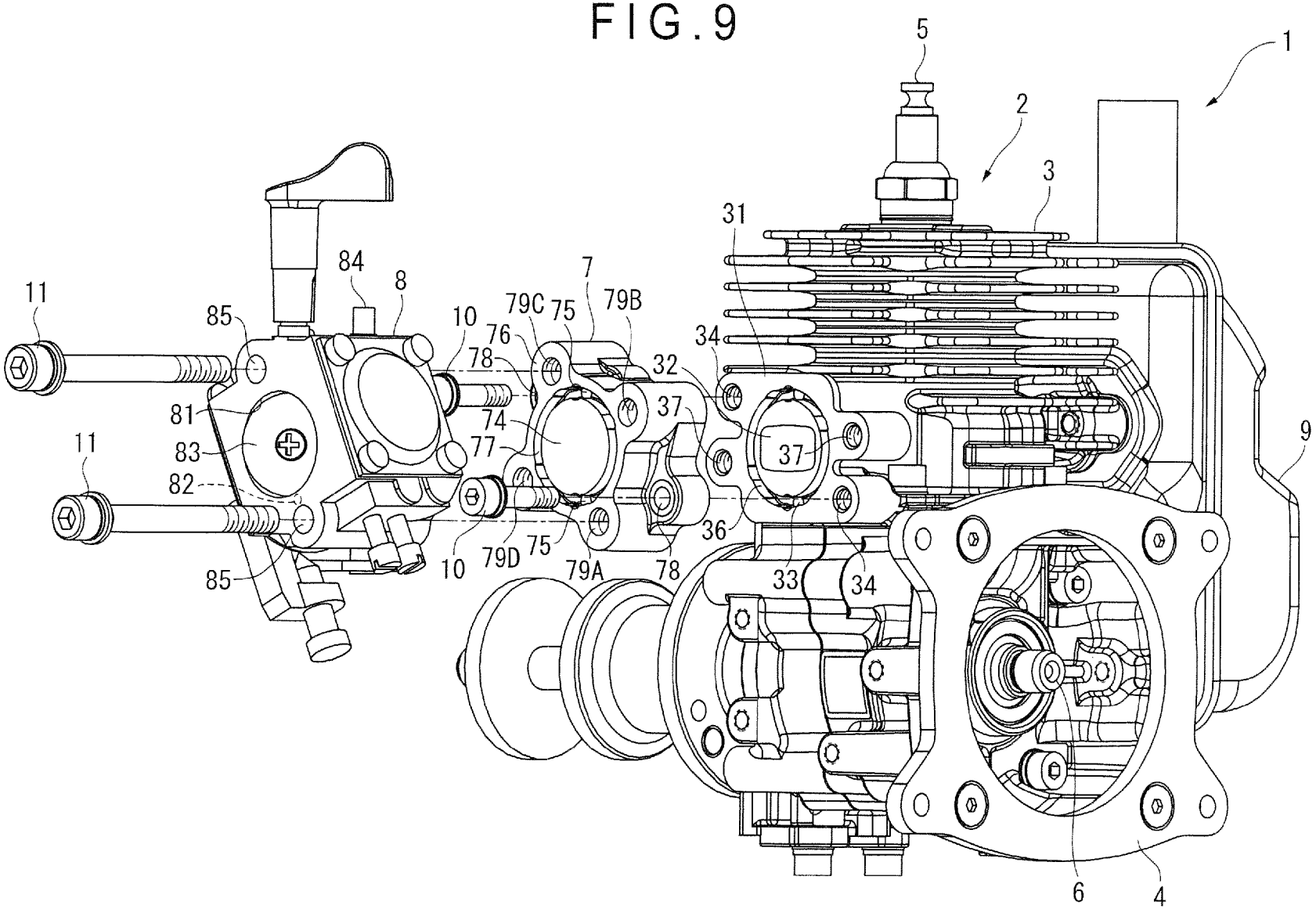
FIG. 9 is an exploded perspective view schematically illustrating a primary portion of a two-stroke engine according to a third exemplary embodiment of the invention.

FIG. 9 is an exploded perspective view of a primary portion of the two-stroke engine 1 according to a third exemplary embodiment of the invention.

In the third exemplary embodiment, as shown in FIG. 9, the carburetor 8 is mounted on the insulator 7 in a rotated manner at any of four positions. Further, the insulator 7 is mounted on the cylinder 3 in a rotated manner at any of two positions, i.e., a predetermined position and a position spaced by 45 degrees from the predetermined position.

In addition to the arrangement of the two-stroke engine 1 according to the first exemplary embodiment, screw holes 37 for mounting the insulator 7 are provided on the contacting surface 31 of the cylinder 3, the contacting surface 31 contacts the insulator 7. The screw holes 37 are respectively formed at positions being counterclockwise rotated by 45 degrees from the screw holes 34 for mounting the insulator 7 around the axial center of the intake hole 32.

Also, the circular communicating groove 36 is provided in the same manner as in the second exemplary embodiment because the insulator 7 can be rotated to be mounted on the cylinder 3 at the contacting surface 31 of the cylinder 3.

The bolts 10 for mounting the insulator 7 respectively penetrate the through holes 78 of the insulator 7 to be screwed with the screw holes 34 or 37 of the cylinder 3, and the bolts 11 for mounting the carburetor 8 respectively penetrate the through holes 85 of the carburetor 8 to be screwed with the screw holes 79 of the insulator 7.

When the insulator 7 is fixed by the screw holes 34, the carburetor 8 can be mounted on the insulator 7 at any of four positions spaced 90 degrees from each other by being rotated. Further, when the insulator 7 is fixed by the screw holes 37 respectively spaced 45 degrees from the respective screw holes 35, the carburetor 8 can be also mounted to the insulator 7 at any of four positions spaced 90 degrees from each other by being rotated. Consequently, the carburetor 8 can be mounted on the cylinder 3 at any of eight positions spaced 45 degrees from each other relative to the cylinder 3.

In short, a number of mounting positions of the carburetor 8 relative to the engine body 2 can be increased compared with the first and second exemplary embodiments.

Also, since the communicating groove 36 is provided on the contacting surface 31 of the cylinder 3, the contacting surface 31 contacting the insulator 7, the pulse hole 33 of the cylinder 3 and one of the pulse holes 75 of the insulator 7 can communicate with each other through the communicating groove 36 similarly to the second exemplary embodiment.

The invention is not limited to the exemplary embodiments described above, but includes other arrangements as long as an object of the invention can be achieved, which includes the following modifications.

A number, a position, and a specific arrangement (a bolt, a through hole, a screw hole and the like) of the mounting unit are not limited. It is only necessary that the carburetor 8 can be mounted on the engine body 2 at any of a plurality of positions through the insulator 7 by the mounting unit.

Although the mounting unit(s) is positioned on both or either of a contacting surface at which the engine body 2 and the insulator 7 contact each other and a contacting surface at which the insulator 7 and the carburetor 8 contact each other according to the exemplary embodiments, two insulators may be provided and the mounting units may be positioned on contacting surfaces of the two insulators as long as the mounting unit(s) is positioned on a place where the carburetor can be mounted on the engine body 2 at a plurality of positions.

Although possible mounting positions of the carburetor 8 relative to the engine body 2 are the four positions spaced 90 degrees from each other according to the first and second exemplary embodiments or the eight positions spaced 45 degrees from each other according to the third exemplary embodiment, three positions spaced 120 degrees from each other, six positions spaced 60 degrees from each other, or the like may be employed as the mounting positions. A number of the mounting positions can be suitably increased depending on a design of an equipment on which the engine is mounted, for instance, a radio-controlled model airplane.

Although a number of the mounting positions is varied depending on a number of the screw holes 79, 35 and 37 according to the first through third exemplary embodiments, a number of the flange 73 of the insulator 7 may be varied as long as the number of the mounting positions of the carburetor 8 relative to the engine body 2 can be varied.

Although the communicating grooves 36 and 79 are respectively formed on the contacting surface 31 of the cylinder 3 and the contacting surface 76 of the insulator 7, the communicating grooves 36 and 79 may be respectively formed on the surfaces opposing to the contacting surfaces 31 and 76 or may be respectively formed on both of the contacting surfaces 31 and 76 and the surfaces opposing thereto. In other words, it is only necessary that the pulse holes 33, 75 and 82 can communicate with each other as communicating holes of the cylinder 3, the insulator 7 and the carburetor 8 when the carburetor 8 is rotated to be mounted.

Although the communicating hole is provided by the pulse hole, the communicating hole may be provided by a leading air passage or the like as long as a hole is provided to intercommunicate the cylinder 3, the insulator 7 and the carburetor 8.

According to the third exemplary embodiment, the mounting unit is capable of mounting the carburetor 8 on the insulator 7 at four positions spaced 90 degrees from each other and mounting the insulator 7 on the cylinder 3 at a predetermined position and a position spaced 45 degrees from the predetermined position in a rotational direction of the carburetor 8. However, the mounting unit may be capable of mounting insulator 7 on the cylinder 3 at four positions spaced 90 degrees from each other and mounting that the carburetor 8 on the insulator 7 at a predetermined position and a position spaced 45 degrees from the predetermined position in the rotational direction of the carburetor 8. Shortly, it is only necessary that one mounting position at one contacting surface is different from the other mounting position at the other contacting surface.

Although the communicating grooves 36 and 77 have a ring-shape, the communicating grooves 36 and 77 may be square-shaped or the like as long as the communicating grooves are cycling grooves such that all the pulse holes of the cylinder 3, the insulator 7 and the carburetor 8 can communicate with each other.

INDUSTRIAL APPLICABILITY

The invention is applicable as an engine in which a position of a throttle lever of a carburetor can be changed, particularly as an engine for hobby-use.

The invention claimed is:

1. An engine including an engine body, an insulator, and a carburetor, each of which includes an intake hole, the carburetor being mountable on the engine body via the insulator such that all of the intake holes communicate with each other, the engine comprising:

a mounting unit by which the carburetor is mountable on the engine body at any of a plurality of mounting positions by rotation about an axial center of the intake holes;

wherein:

the mounting unit mounts the insulator on the engine body at a predetermined position, and the carburetor is mountable on the insulator by the mounting unit at any of the plurality of mounting positions by the rotation about the axial center of the intake holes, the carburetor is mounted on the engine body at one of the plurality of mounting positions, and the insulator is provided with a contacting surface and a plurality of communicating holes independent from the intake hole thereof, the contacting surface making contact with the carburetor, the communicating holes being symmetrical with respect to the axial center of the intake holes and intercommunicating between a communicating hole provided in the carburetor and a communicating hole provided in the engine body while a circular communicating groove that intercommunicates between the communicating hole provided in the carburetor and one of the plurality of communicating holes provided in the insulator is provided on the contacting surface of the insulator.

2. An engine including an engine body, an insulator, and a carburetor, each of which includes an intake hole, the carburetor being mountable on the engine body via the insulator such that all of the intake holes communicate with each other, the engine comprising:

a mounting unit by which the carburetor is mountable on the engine body at any of a plurality of mounting positions by rotation about an axial center of the intake holes;

wherein:

the mounting unit mounts the carburetor on the insulator at a predetermined position, and the insulator is mountable on the engine body at any of the plurality of mounting positions by rotation about the axial center of the intake holes, the carburetor is mounted on the engine body at one of the plurality of mounting positions, and the insulator is provided with a communicating hole independently from the intake hole, the communicating hole intercommunicating between a communicating hole provided in the carburetor and a communicating hole provided in the engine body while a circular communicating groove that intercommunicates between the communicating hole provided in the engine body and the communicating hole provided in the insulator is provided on a contacting surface at which the engine body and the insulator contact each other.

3. An engine including an engine body, an insulator, and a carburetor, each of which includes an intake hole, the carburetor being mountable on the engine body via the insulator such that all of the intake holes communicate with each other, the engine comprising:

a mounting unit by which the carburetor is mountable on the engine body at any of a plurality of mounting positions by rotation about an axial center of the intake holes;

wherein:

the carburetor is mountable on the insulator by the mounting unit at any of a plurality of mounting positions by rotation about the axial center of the intake holes and the insulator is mountable on the engine body at any of a plurality of mounting positions by rotation about the axial center of the intake holes, the carburetor is mounted on the engine body at one of the plurality of mounting positions, and the insulator is provided with a communicating hole separately from the intake hole, the communicating hole intercommunicating between a communicating hole provided in the carburetor and a communicating hole provided in the engine body while a circular communicating groove that intercommunicates between the communicating hole provided in the carburetor and a communicating hole provided in the insulator is provided on a contacting surface at which the carburetor and the insulator contact each other and another circular communicating groove that intercommunicates between the communicating hole provided on the engine body and the communicating hole provided on the insulator is provided on a contacting surface at which the engine body and the insulator contact each other.

* * * * *